US006699062B1

(12) United States Patent
Barnett et al.

(10) Patent No.: US 6,699,062 B1
(45) Date of Patent: Mar. 2, 2004

(54) INSULATION PIERCING FASTENER

(75) Inventors: Gary Barnett, Leicestershire (GB); Mark David Kirkman, Nottinghamshire (GB); David John Hollick, Oxford (GB)

(73) Assignee: Tyco Electronics UK Limited (GB)

( * ) Notice: Subject to any disclaimer, the term of this patent is extended or adjusted under 35 U.S.C. 154(b) by 28 days.

(21) Appl. No.: 10/129,608

(22) PCT Filed: Nov. 7, 2000

(86) PCT No.: PCT/GB00/04270

§ 371 (c)(1),
(2), (4) Date: May 8, 2002

(87) PCT Pub. No.: WO01/35495

PCT Pub. Date: May 17, 2001

(30) Foreign Application Priority Data

Nov. 10, 1999 (GB) ..... 9926519

(51) Int. Cl.[7] ..... H01R 11/20; H01R 4/24; H01R 4/26

(52) U.S. Cl. ..... 439/416; 439/433

(58) Field of Search ..... 439/415, 416, 439/428, 429, 431, 433, 411, 413

(56) References Cited

U.S. PATENT DOCUMENTS

| | | | | |
|---|---|---|---|---|
| 1,963,542 A | * | 6/1934 | Bergstrom | 411/386 |
| 3,129,048 A | | 4/1964 | Broch | |
| 3,191,131 A | | 6/1965 | Schiffmann | |
| 3,865,007 A | * | 2/1975 | Stanback | 439/814 |
| 4,072,393 A | * | 2/1978 | McDermott et al. | 439/811 |
| 4,113,337 A | | 9/1978 | McKee | |
| 5,102,347 A | | 4/1992 | Cote et al. | 439/412 |
| 5,816,844 A | * | 10/1998 | Perera | 439/416 |
| 6,042,430 A | * | 3/2000 | Hollick | 439/797 |
| 6,099,344 A | * | 8/2000 | Chadbourne | 439/416 |
| 6,402,544 B1 | * | 6/2002 | Barnett | 439/416 |

FOREIGN PATENT DOCUMENTS

| | | |
|---|---|---|
| EP | 0 183 587 | 6/1986 |
| EP | 0 420 060 | 4/1991 |
| EP | 0 711 004 | 5/1996 |
| EP | 0 691 712 | 10/1996 |

OTHER PUBLICATIONS

Copy of PCT Search Report for PCT/GB00/04270.
Copy of International Preliminary Examination Report for PCT/GB00/04270.

* cited by examiner

*Primary Examiner*—Hae Moon Hyeon
(74) *Attorney, Agent, or Firm*—Myers Bigel Sibley & Sajovec

(57) ABSTRACT

Insulation-piercing fasteners are provided having a generally cylindrical shank, externally threaded along at least part of its length. The end portion of the shank is configure to engage an insulated electrical conductor and is formed with a hollowed end portion. The hollowed end portion has a generally cylindrical recess having a diameter less than the diameter of the shank. The wall of the hollowed end portion has at least one interruption. The width of the interruption is less than the maximum internal width of the hollowed end portion.

11 Claims, 5 Drawing Sheets

INSULATION PIERCING FASTENER

RELATED APPLICATIONS

The present application is a National Phase application of PCT/GB00/04270 filed on Nov. 7, 2000 and published in English, which claims priority from Application GB 9926519.1 filed on Nov. 10, 1999.

FIELD OF THE INVENTION

This invention relates to an insulation-piercing fastener, ie to a fastener intended for clamping engagement with an insulated electrical conductor in such a manner that the insulation is broken and electrical connection is established between the conductor and the fastener.

BACKGROUND OF THE INVENTION

One known form of insulation-piercing fastener is intended for use with conductors having a stranded core. Such conductors commonly have insulation consisting of mineral oil-impregnated paper. The shank of this fastener has a generally cylindrical form, the tip of the fastener being formed with a diametric slot. When the tip of the fastener engages the insulated conductor the edges of the slot act as blades to cut away the insulation. Such fasteners generally cannot be used with conductors having insulation in the form of a plastics coating.

Another form of known fastener is suitable for use with plastics-insulated conductors, which generally have solid cores. This fastener has a tip formed as a circular blade. Such fasteners are not suitable for use with conductors having stranded cores and paper coatings since the area of contact between the conductor and the tip of the fastener is small and the blade tends to cut through the individual conductor strands.

The different forms of insulation-piercing fastener which must be used with different types of conductor means that a fitter must carry a supply of both. Problems can occur if the wrong fastener is used with any particular conductor.

SUMMARY OF THE INVENTION

There has now been devised an improved form of insulation-piercing fastener which overcomes or substantially mitigates the above mentioned or other disadvantages of the prior art.

According to the invention, there is provided an insulation-piercing fastener having a generally cylindrical shank, externally threaded along at least part of its length, the end portion of the shank which, in use, engages an insulated electrical conductor being formed with a hollowed end portion and the wall of said hollowed end portion having at least one interruption, the width of said at least one interruption being less than the maximum internal width of said hollowed end portion.

The fastener according to the invention is advantageous primarily in that it may be used satisfactorily with a range of different forms of insulated conductor, including conductors having solid cores and plastics insulation and conductors having stranded cores with mineral oil-impregnated paper insulation. The hollowed end portion of the fastener is able to accommodate a substantial quantity of insulation cut away from the conductor, whilst the contact area between the tip of the fastener and the conductor is sufficiently great to give good electrical contact.

The end portion of the shank will preferably be hollowed by virtue of having a recess formed in it, which recess will obviously be of somewhat lesser diameter than the shank itself. The recess may be a blind recess or may extend throughout the length of the fastener to form a bore. Whilst a bore of this form (ie a bore extending throughout the length of the fastener) may not be necessary for operation of the fastener it may be simpler to manufacture than a blind recess.

Also, at least part of the bore may be of non-circular cross-section for engagement with a drive component by which the fastener can be rotated. In such a case, the part of the bore that constitutes the hollowed end portion of the shank may be of circular cross-section or of non-circular cross-section, eg it may be a continuation of a bore of non-circular, eg square or hexagonal, cross-section formed for engagement with the drive component.

The size of the hollowed end portion relative to the overall cross-sectional area of the shank is preferably such that in the plane of the tip of the shank the hollowed end portion accounts for between 10% and 60% of the cross-sectional area of the shank.

The tip of the fastener is preferably formed with a pair of diametrically opposed interruptions which together define a slot extending across the end portion of the bolt.

The shank preferably has a diameter in the range 3 to 30 mm. The dimensions of the interruption(s) in the wall of the hollowed end portion, and the number of such interruptions, will generally be commensurate with the size of the fastener, and with the nature of the insulated conductor with which it is to be used. Typically, the interruption is between 0.5 and 5 mm in width and has a depth of between 0.5 and 20 mm.

The fastener according to the invention may be manufactured in any material which is electrically conductive and has the requisite mechanical properties. Most preferably, the bolt is formed in brass or copper.

According to another aspect of the invention, there is provided an electrical connector including a socket adapted to receive an electrical conductor, a wall of said socket having a threaded bore in which an insulation-piercing fastener as defined above is received.

BRIEF DESCRIPTION OF THE DRAWINGS

The invention will now be described in greater detail, by way of illustration only, with reference to the accompanying drawings, in which.

DETAILED DESCRIPTION OF THE ILLUSTRATED EMBODIMENTS

Figure 1:
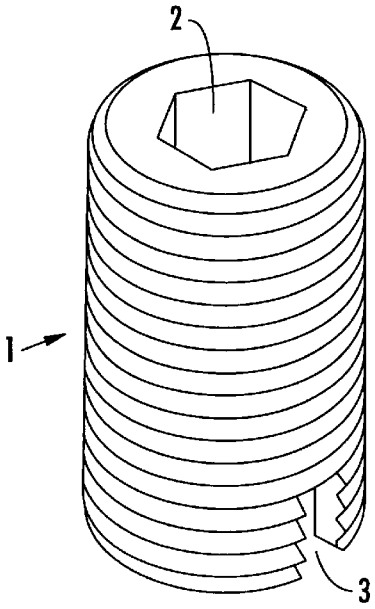
FIG. 1 is a perspective view of a first embodiment of a fastener according to the invention.
Figure 2:
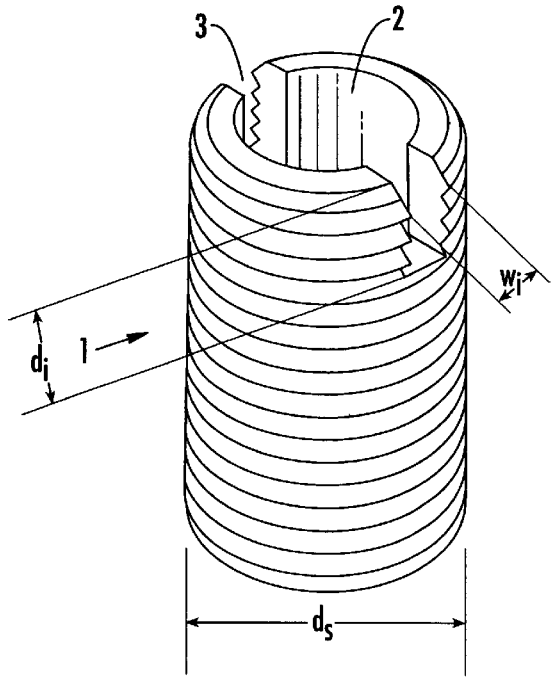
FIG. 2 is a perspective view of the fastener of FIG. 1 in an inverted condition.

Referring first to FIG. 1 and FIG. 2, an insulation-piercing fastener according to the invention is generally designated 1 and comprises a generally cylindrical and externally threaded shank having an external diameter $d_s$. A bore 2 extends through the full length of the shank. In the upper part of the bore 2 it is of hexagonal cross section, whilst the lowermost part of the bore 2 is of circular cross section and defines a hollowed end portion of the shank. The tip of the fastener is formed with a pair of diametrically opposed interruptions 3 in the wall of the circular part of the bore 2.

Figure 3:
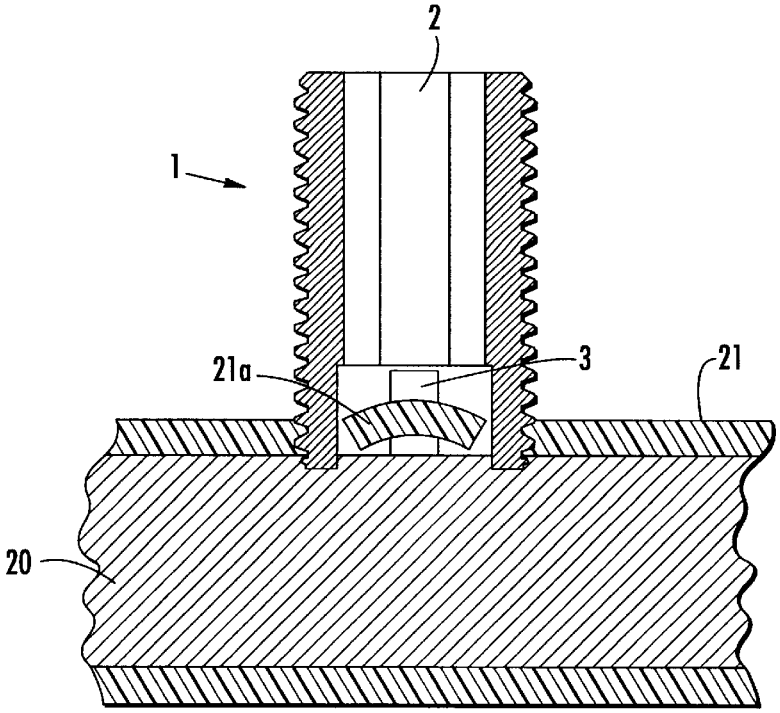
FIG. 3 is a schematic view of the fastener of FIGS. 1 and 2 engaged with an insulated electrical conductor.

The general mode of operation of the bolt 1 is illustrated in FIG. 3. This shows the fastener 1 engaged with a conductor 20 having a layer of insulation 21. The conductor 20 may be of the stranded or solid core type and the insulation may be, for example, of plastics material or mineral oil-impregnated paper. When the tip of the bolt is brought into clamping engagement with the insulation 21 the lower edges of the fastener act as a pair of semi-circular blades which cut into and through the insulation 21. Displaced insulation 21*a* is accommodated within the lower part of the bore 2 and electrical contact is established between the conductor 20 and the lower edges of the fastener 1.

In a particularly preferred embodiment, the fastener 1 is an M16 bolt of length 28 mm. The diameter $d_b$ defining the maximum internal width of the circular part of the bore 2 is 8.7 mm and the interruptions 3 have a width $w_i$ of 3.2 mm and a depth $d_i$ of 6 mm. The fastener 1 is made of brass or copper.

Figure 4:
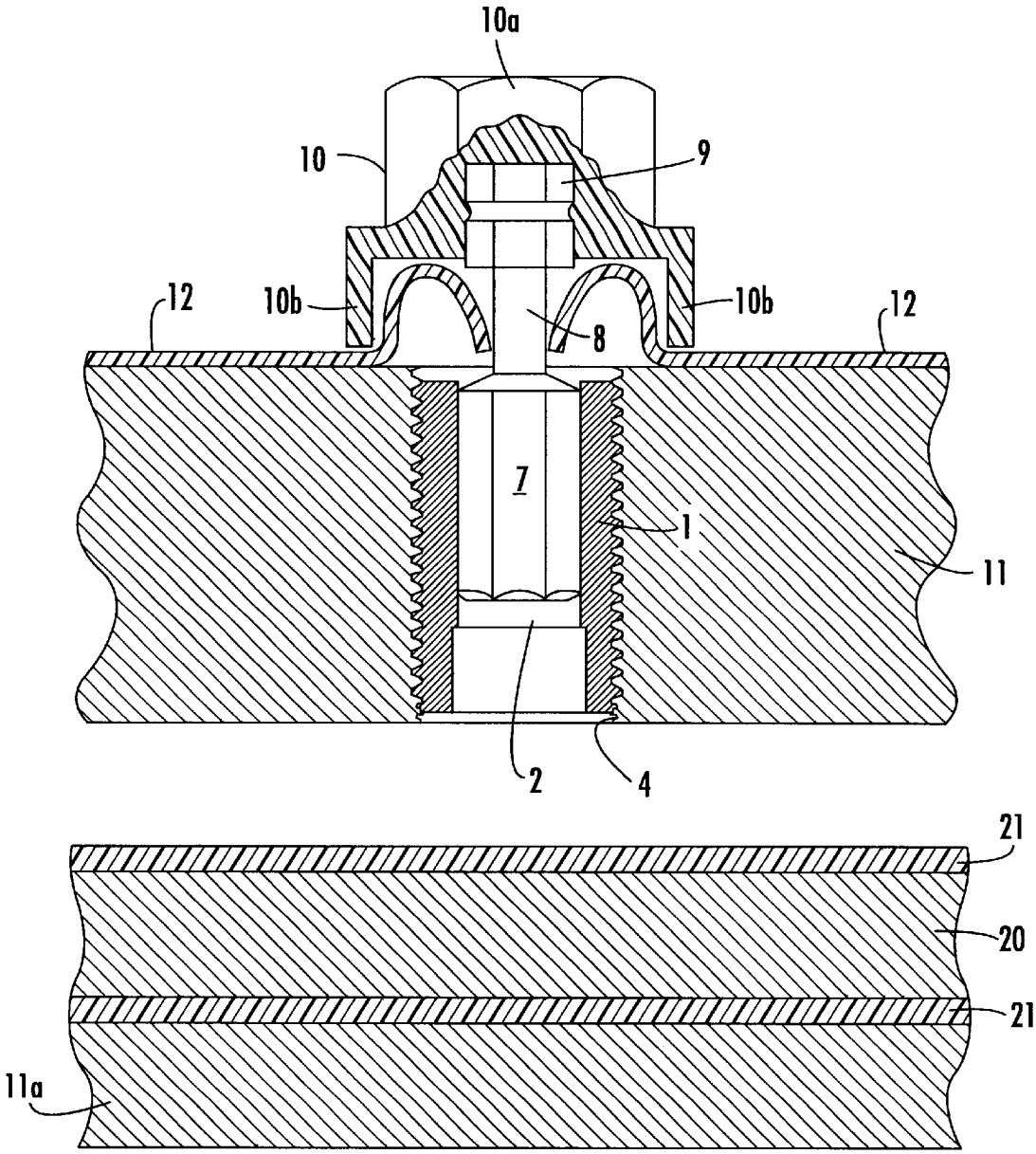
FIG. 4 is a fragmentary side view in section of an electrical connector in which a fastener according to the invention may be used in a first stage of use.
Figure 5:
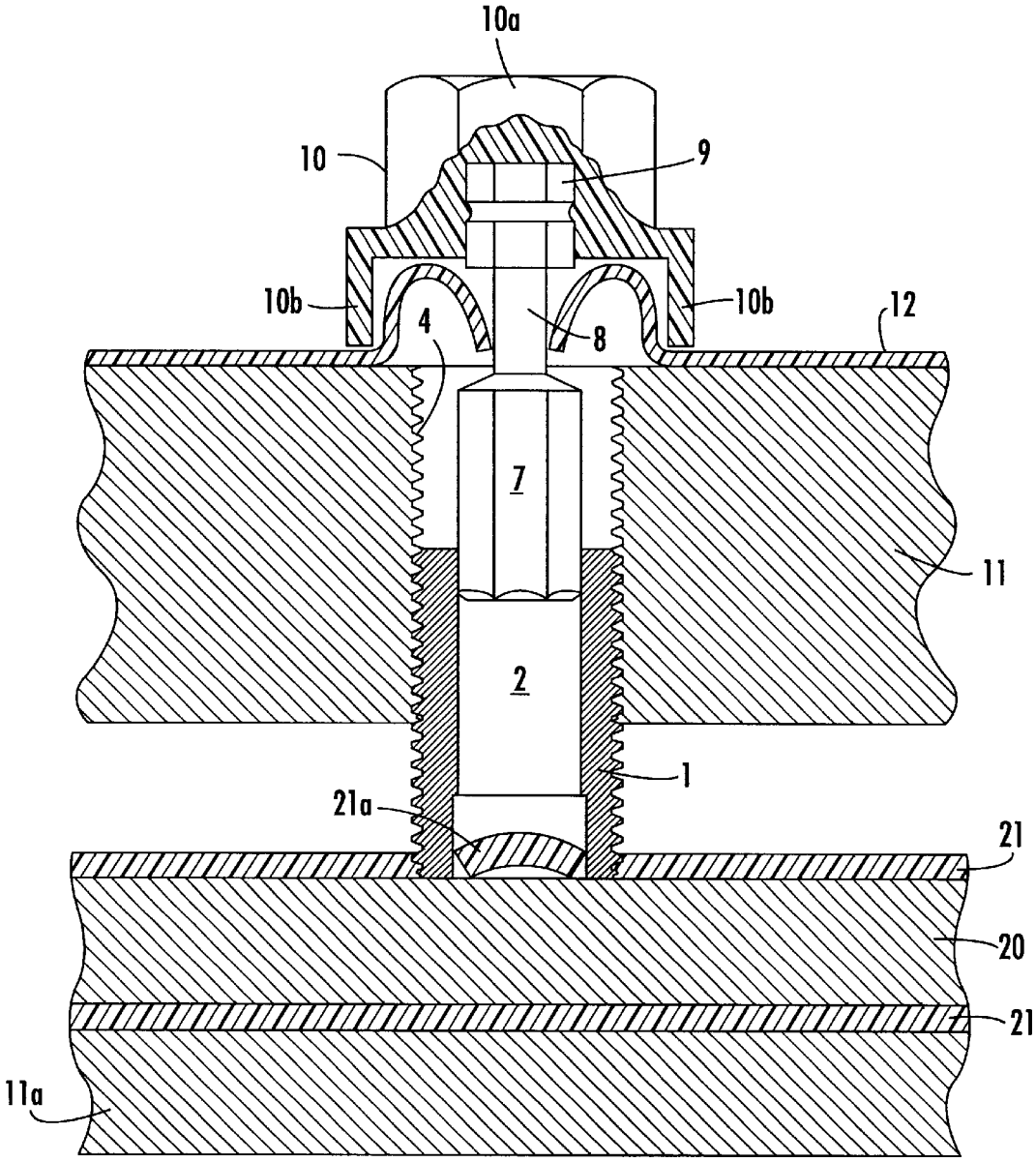
FIG. 5 is a view similar to FIG. 4 of the connector in an intermediate stage of use.
Figure 6:
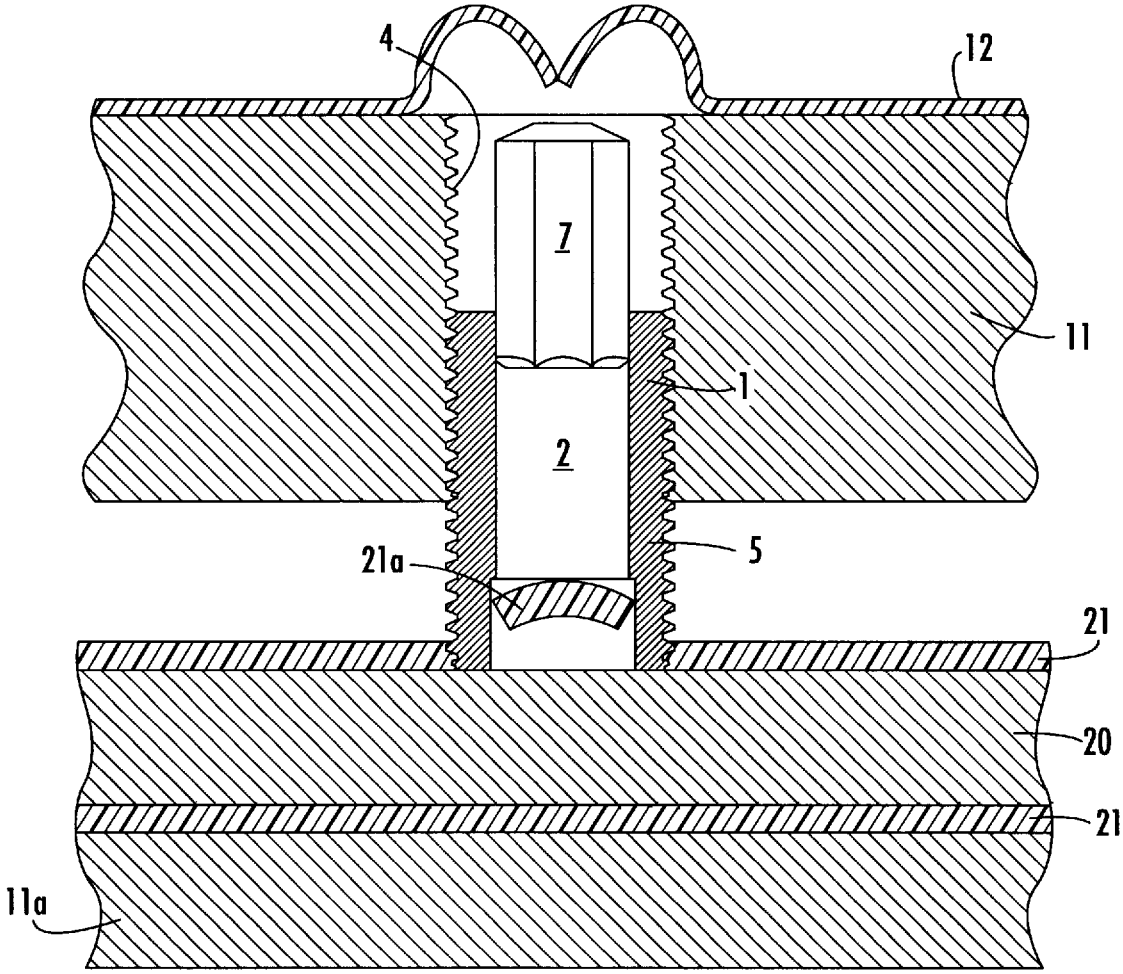
FIG. 6 is a view similar to FIGS. 4 and 5 of the connector in a final stage of use.

The manner in which the fastener 1 is used in one particular form of electrical connector is illustrated in FIGS. 4 to 6. In this embodiment, an electrical connector comprises a body 11 of electrically conductive material (typically a metal such as brass or aluminium) which is provided on its surface with an electrically-insulating plastics shroud 12. The body 11 is either formed integrally with, or is fastened to, a reaction member 11*a*, the space between the body 11 and the reaction member 11*a* defining a channel or bore in which an electrical conductor 20 can be received. The conductor 20 is typically a solid conductor with a plastics sheath 21, but may alternatively be a stranded conductor with a mineral oil impregnated sheath.

The body 11 has a threaded bore 4 within which a fastener 1 is received. A bore 2 of hexagonal (or other non-circular) cross-section is broached within the fastener 1 and extends along the longitudinal axis of the bolt 1. A drive spindle 7, typically of brass or steel, with a cross-section matching that of the bore 2 is received within the bore 2 with a close sliding fit. The spindle 7 has a co-axial, upwardly extending extension piece 8 which terminates in a head 9. The junction between the spindle 7 and the extension piece 8 constitutes a neck at which the assembly can shear, as described below, when a predetermined torque is applied to the extension piece 8.

A cap 10 of plastics material is moulded about the head 9. The cap 10 has an hexagonal upper portion 10*a*, which is dimensioned to fit a suitable tool, and a downwardly depending circular skirt 10*b* which rests on the upper surface of the shroud 12. In the region encompassed by the skirt 10*b*, the shroud 12 extends across the open upper end of the threaded bore 4, the shroud 12 in this region adopting the form of a petal washer, through the centre of which the extension piece 8 extends.

FIG. 4 shows the components of the connector in the condition in which they are assembled and supplied, immediately after the conductor 20 has been received in the channel between the body 11 and the reaction member 11*a*. In this condition, all readily accessible surfaces of the connector are electrically insulated, either by the shroud 12 or by the cap 10. Likewise, the conductor 20 is insulated by its plastics sheath 21. Thus, the connector can safely be fitted around the conductor 20 when the conductor 20 is live.

To establish connection between the conductor 20 and the body 11 of the connector, the cap 10 is rotated by means of a spanner, socket wrench or the like. Rotation of the cap 10 causes rotation of the spindle 7 and this in turn rotates the fastener 1 within the threaded bore 4. The spindle 7 is held in a constant position relative to the body 11 by the skirt 10*b*, but the fastener 1 is driven downwards into contact with the sheath 21 of the conductor 20. The spindle 7 thus remains captive within the bore 2 but slides relative to the fastener 1.

Continued rotation of the cap 10 causes the tip of the fastener 1 to penetrate through the sheath 21 and to come into contact with the live conductor 20 (see FIG. 5). Engagement of the tip of the fastener 1 with the conductor 20 produces a resistance to further rotation of the cap 10. The torque applied to the spindle 7 thus increases and a point is reached at which the extension piece 8 shears from the spindle 7. The cap 10 with the captive extension piece 8 is thus released from the connector, as shown in FIG. 6.

When the cap 10 and extension piece are so removed, the portions of the plastics sheath 12 which previously surrounded the extension piece 8 relax to the positions shown in FIG. 6, in which they substantially close the opening of the bore 4. Thus, electrical connection is established between the conductor 20 and the body 11 of the connector, without exposing the operator at any time to any electrically live surfaces. Insulating material 21*a* cut from the sheath 21 by the cutting action of the tip of the fastener 1 is accommodated within the circular cross-section lower part of the bore 2 in the fastener 1.

In the embodiment described, the spindle 7 and extension piece 8 are of metal. It will be appreciated, however, that these components do not need to be electrically conducting. A metal such as brass or steel is used merely because it enables the extension piece and spindle to be produced with the requisite mechanical strength and to shear at the desired torque. In principle, the spindle, extension piece and the cap could be moulded integrally in plastics material, if such a material also provides these properties.

Figure 7:
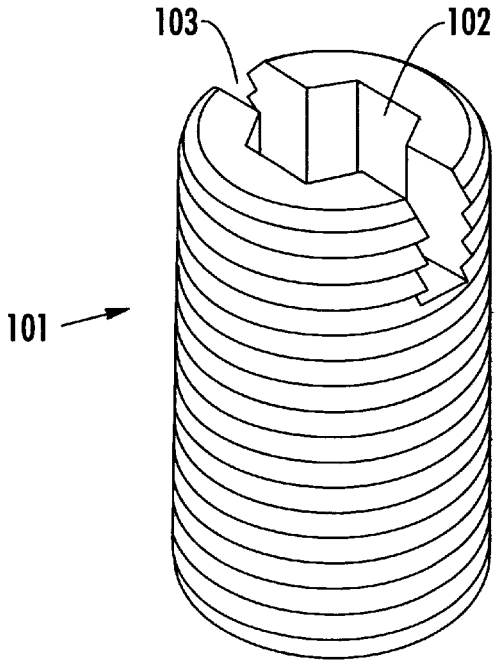
FIG. 7 is a view similar to FIG. 2 of a second, currently preferred, embodiment of a fastener according to the invention.
Figure 8:
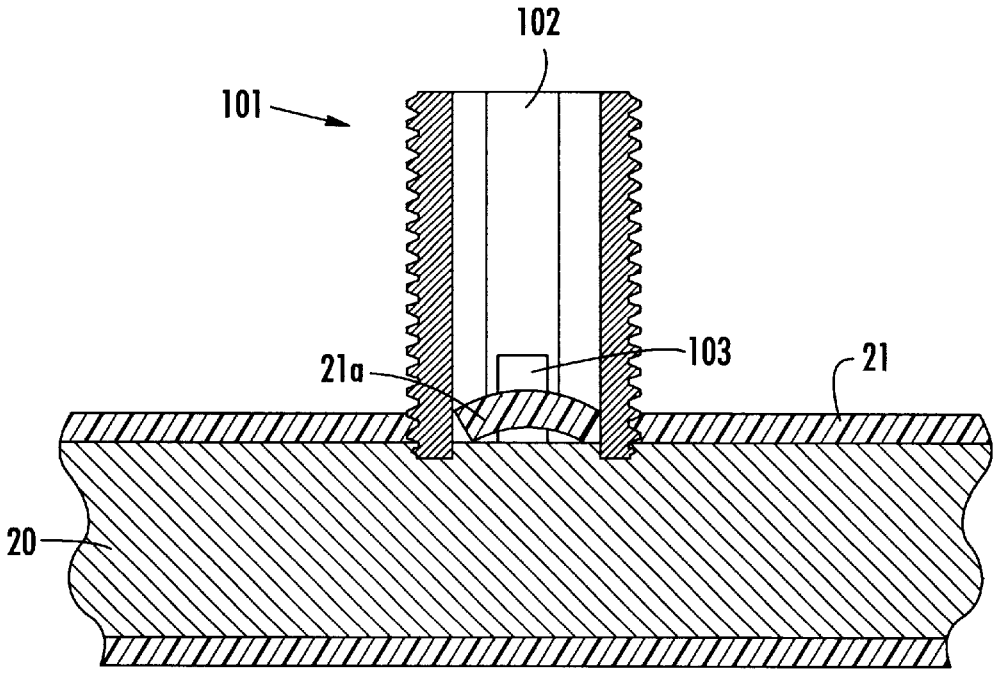
FIG. 8 is a view similar to FIG. 3 showing the fastener of FIG. 7.

The embodiment, generally designated 101, illustrated in FIGS. 7 and 8 is similar in function to that described above, but differs therefrom in that the recess in the tip of the fastener 101 is not circular in cross-section. Instead, the recess is simply the terminal part of a hexagonal bore 102 which extends axially along the full length of the fastener 101. Once again, a pair of interruptions 103 are provided, at diametrically opposite points in the wall of the end portion of the fastener 101. As for the first embodiment, the tip of the fastener 101 cuts through insulation 21 of a conductor 20, displaced insulation material 21*a* being accommodated within the hollow tip of the fastener 101.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. An insulation-piercing fastener comprising:

a generally cylindrical shank, the shank being externally threaded along at least part of its length;

a hollowed end portion of the shank configured to engage an insulated electrical conductor, the hollowed end portion having a generally cylindrical recess having a smaller diameter than the shank, the hollowed end portion having an associated maximum internal width; and at least one interruption in the hollowed end portion, the at least one interruption having a width of between about 0.5 and about 5 millimeters (mm) and a depth of between about 0.5 and about 20 mm, the width of the at least one interruption being less than the maximum internal width of the hollowed end portion.

2. The fastener of claim 1 wherein the recess comprises either a blind recess or part of a bore extending throughout a length of the shank.

3. The fastener of claim 2 wherein at least part of the bore is of square or hexagonal cross-section for engagement with a drive component by which the fastener can be rotated.

4. The fastener of claim 3 wherein the diameter of the shank is between about 6 and about 30 millimeters (mm).

5. The fastener of claim 4 wherein a cross-sectional area of the recess is between about 10% and about 60% of a cross-sectional area of the shank.

6. An electrical connector comprising:

a socket adapted to receive an electrical conductor;

a threaded bore in the socket and extending therethrough;

an externally threaded shank rotatably received in the bore, the shank including a hollow end portion configured to engage an insulated electrical conductor positioned in the socket, the hollowed end portion having a generally cylindrical recess having a smaller diameter than the shank, the hollowed end portion having an associated maximum internal width;

at least one interruption in the hollowed end portion, the at least one interruption having a width less than the maximum internal width of the hollowed end portion; and wherein the hollowed end portion comprises a bore extending along a length of the shank, the shank having an engagement end portion opposite the hollow end portion configured to receive a drive component, the electrical connector further comprising:

the drive component positioned in the engagement end and adapted to rotate the shank;

a cap positioned on an outer face of the socket adjacent to and covering the threaded bore; and a head positioned in the cap and connected to the drive component to rotate the drive component when the cap is rotated.

7. The connector of claim 6 wherein the socket and the shank are comprised at least in part of an electrically conductive material to provide an electrical connection therebetween and wherein an outer surface of the socket and an outer surface of the cap are comprised of an electrically insulated material.

8. The connector of claim 7 wherein the head is connected to the drive component at a neck adapted to shear when a predetermined torque is applied to the head.

9. An electrical connector comprising:

a socket adapted to receive an electrical conductor;

a threaded bore in the socket and extending therethrough;

an externally threaded shank rotatably received in the bore, the shank including a hollow end portion configured to engage an insulated electrical conductor positioned in the socket, the hollowed end portion having a generally cylindrical recess having a smaller diameter than the shank, the hollowed end portion having an associated maximum internal width;

at least one interruption in the hollowed end portion, the at least one interruption having a width less than the maximum internal width of the hollowed end portion;

wherein the electrical connector further comprises a drive component positioned to engage an end of the shank opposite the hollow end portion and adapted to rotate the shank and a cap positioned on an outer face of the socket adjacent the drive component and coupled to the drive component to rotate the drive component.

10. The connector of claim 9 wherein an outer surface of the socket and an outer surface of the cap comprise an electrically insulating material.

11. An electrical connector comprising:

a socket adapted to receive an electrical conductor;

a threaded bore in the socket and extending therethrough;

an externally threaded shank rotatably received in the bore, the shank including a hollow end portion configured to engage an insulated electrical conductor positioned in the socket, the hollowed end portion having a generally cylindrical recess having a smaller diameter than the shank, the hollowed end portion having an associated maximum internal width;

at least one interruption in the hollowed end portion, the at least one interruption having a width less than the maximum internal width of the hollowed end portion; and wherein an outer surface of the socket comprises an electrically insulating material.

* * * * *